US005598633A

United States Patent [19]

Hartz

[11] Patent Number: 5,598,633

[45] Date of Patent: Feb. 4, 1997

[54] METHOD OF MANUFACTURING A CASTER ROLL CORE AND SHELL ASSEMBLY

[75] Inventor: Warren C. Hartz, McKenzie, Tenn.

[73] Assignee: Norandal USA, Inc., Brentwood, Tenn.

[21] Appl. No.: 392,427

[22] Filed: Feb. 22, 1995

Related U.S. Application Data

[63] Continuation-in-part of Ser. No. 274,186, Jul. 12, 1994.

[51] Int. Cl.[6] ..... B23P 15/00

[52] U.S. Cl. ..... 29/895.212; 29/895.32; 492/46

[58] Field of Search ..... 29/895.2, 895.212, 29/895.32; 492/46, 54, 33, 35, 1, 3; 164/442, 444, 448; 165/89, 90

[56] References Cited

U.S. PATENT DOCUMENTS

| | | | |
|---|---|---|---|
| 4,071,081 | 1/1978 | Chielens et al. | 165/90 |
| 4,773,468 | 9/1988 | Lauener | 492/46 |
| 5,209,283 | 5/1993 | Miltzow et al. | 164/448 |
| 5,265,332 | 11/1993 | Hartz | 29/895.212 |
| 5,292,298 | 3/1994 | Scannell | 492/46 |

*Primary Examiner*—Irene Cuda
*Attorney, Agent, or Firm*—Keck, Mahin & Cate

[57] ABSTRACT

An improved caster roll core and shell assembly are manufactured wherein two overlays of stainless steel of different hardness are deposited on the surface of the roll core, thus prolonging the life of the roll.

7 Claims, 2 Drawing Sheets

METHOD OF MANUFACTURING A CASTER ROLL CORE AND SHELL ASSEMBLY

This application is a continuation in part of Ser. No. 08/274,186 filed Jul. 12, 1994, now abandoned.

FIELD OF THE INVENTION

The present invention is concerned with an improved caster roll core and shell assembly wherein a chromium layer is plated onto the inside surface of the shell and two overlays of stainless steel of different hardness are deposited on the surface of the roll core, thus significantly prolonging the life of the roll.

BACKGROUND OF THE INVENTION

In the manufacture of aluminum foils or sheets, conventional twin roll continuous sheet casting machines comprise a pair of parallel, water-cooled, counter-rotating rolls. After being in use for a given period, the surface of the roll must be reground because of heat cracks resulting from thermal fatigue and out-of-roundness due to galling between caster core and shell. Accordingly, the shells surrounding the cores must be removed periodically, and the cores repaired and reground before rebuilding of the roll assembly.

The major cause of damage to caster roll assemblies is galling between the core and the shell, which occurs when the shell slips relative to the core under load. Cold welding of the core and shell during relative motion causes metal to be torn from the core and displaced in the interface between the two, resulting in distortion of the rolls and roll gap, creating bad shape in the continuously cast sheet.

Using such conventional roll assemblies, it is possible to cast from about 10 to 12 millions pounds of aluminum sheet before cutting of the shells and repairing and regrinding the cores. However, after regrinding two or three times, the hardened layer on the core surface is lost and the cores are destroyed by deformation. To overcome this problem, it became general practice to coat cores with a stainless steel overlay. This modification extended the service life between regrinding by about 50% and avoided destruction of cores by weld rebuilding to original dimensions and regrinding. However, the stainless steel weld overlay is still subject to cold welding and galling between the shell and the core.

Another approach to extend the service life of the core is to coat the inner surface of the shell with hard chromium, as proposed in U.S. Pat. No. 5,265,332, which is hereby incorporated by reference. Again, however, usual problems with the stainless steel overlay are present.

There is therefore a great need to develop a core having an extended service life between shell removal. Preferably, the core would be prepared by simple techniques at a reasonable cost.

SUMMARY OF THE INVENTION

In accordance with the present invention, there is now provided an improved caster roll core and shell assembly wherein the surface of the core is coated with two overlays of stainless steel, each having a distinct hardness. In the preferred embodiment of the invention, the overlay of stainless laying on the surface of the core is softer than the external overlay of stainless steel.

The present invention also comprises the method for manufacturing the improved core.

IN THE DRAWINGS

FIG. 1 is a perspective view of the core of a roll according to the present invention.

DETAILED DESCRIPTION OF THE INVENTION

The present application discloses a roll and shell assembly for making metal sheets, preferably aluminum, wherein the core of the roll comprises a dual layer stainless steel overlay which shows significantly improved properties over the rolls currently known. When used in combination with shells having the inner surface coated with chromium, the service life between shell removal and rebuilding of the rolls is extended by as much as 400%. Furthermore, the cores are found to be relatively undamaged.

Figure 1A:
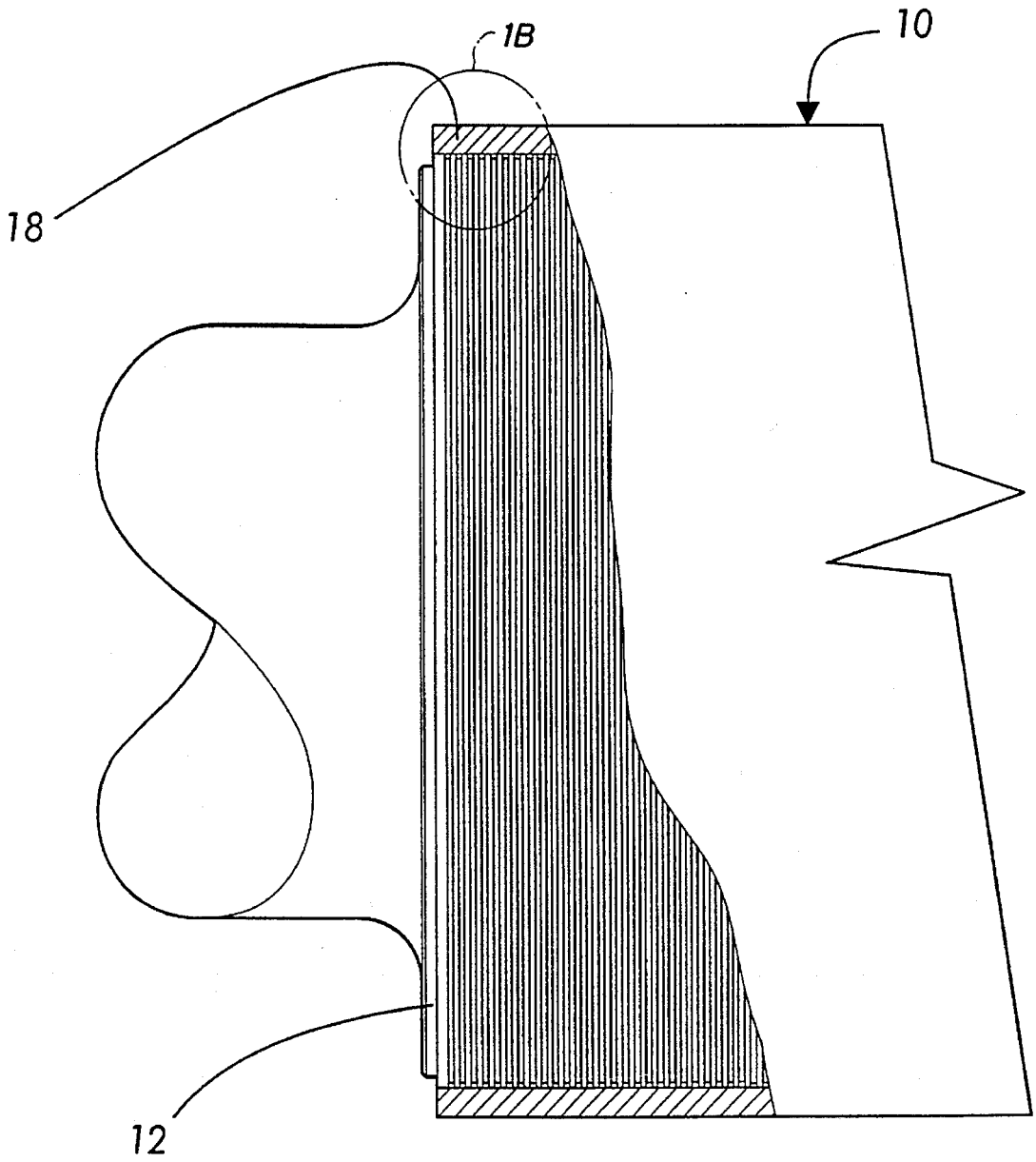
Figure 1B:
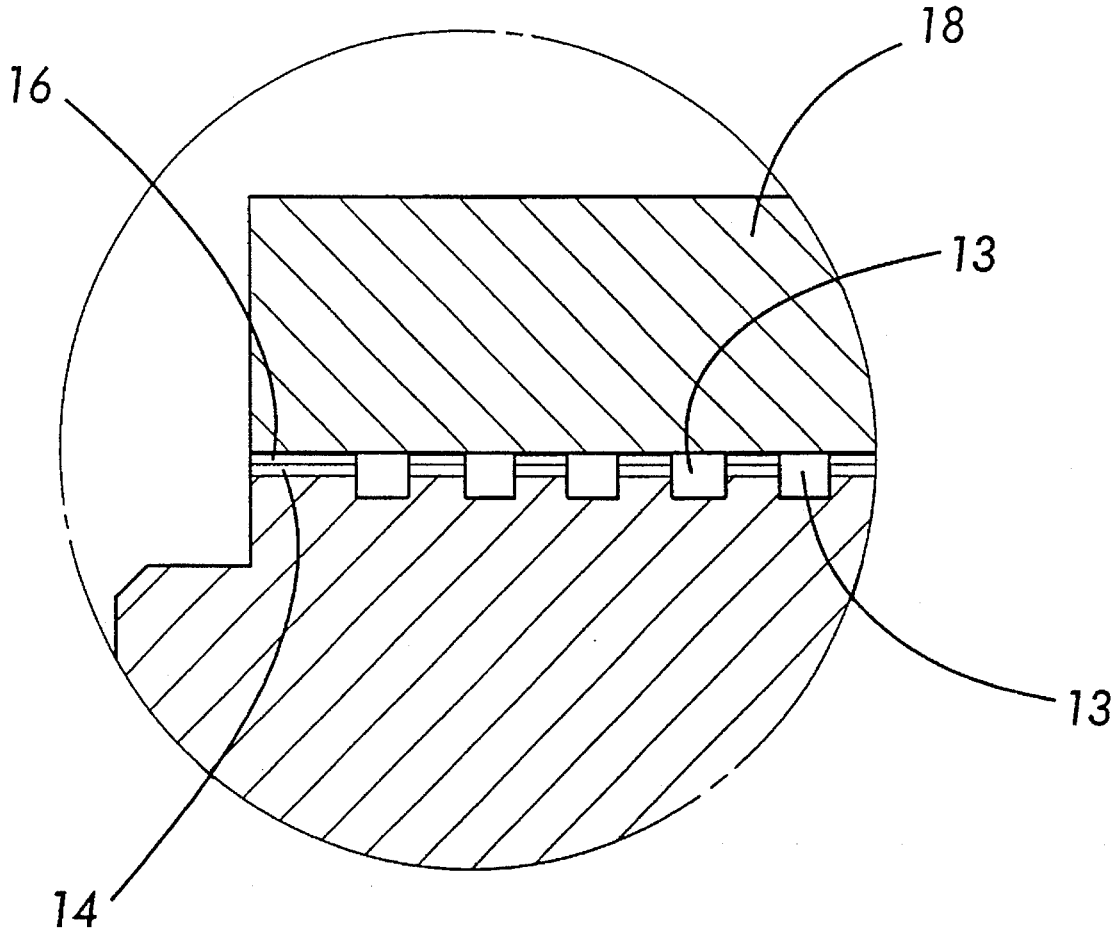

Referring to FIGS. 1A and 1B which illustrates a preferred embodiment of the present invention, there is found a roll 10 comprising a core 12 having a plurality of water channels 13 for cooling, the core 12 being coated with an overlay of stainless steel 14. The thickness of this one pass overlay is preferably at least ⅛, and preferably has a hardness of from 20 to 25 on the Rockwell "C" scale. An example of a suitable stainless steel 14 is LINCORE 30, manufactured and sold by Lincoln Electric, Cleveland, Ohio. It should be noted that overlay 14 may be formed by welding several layers of ⅛" each until the desired thickness is reached.

Onto overlay 14 is laid another overlay of stainless steel 16 having a thickness of at least ⅛", preferably less than 1", and most preferably ⅝", and a hardness of from 50 to 56 on the Rockwell "C" scale. An example of a suitable stainless steel 16 is LINCORE 96S, manufactured and sold by Lincoln Electric, Cleveland, Ohio. Overlay 16 is preferably formed by welding several layers of about ⅛" each until the desired thickness is reached. This provides a structure having better mechanical properties and increased resistance to wear and tear. Once core 12 is coated with overlays 14 and 16, water channels 13 are cut therein. This operation can be carried out with any conventional router, and is rendered necessary to insure that shell 18 (discussed below) is properly cooled when the roll is in use.

A further advantage of overlays 14 and 16 is that they substantially eliminated the breaking of the sidewalls of the water channels in the core, which took place when the core was not provided with these overlays.

Finally, shell 18 preferably made of alloy steel having its inner surface coated with a layer of chromium having a thickness of from 0.001 to 0.01 inch in the manner described in U.S. Pat. No. 5,265,332, is shrink-fitted around overlay 16 in a conventional manner. It is believed that overlay 14 acts as an interface or cushion between the core and overlay 16 to prevent cracking and separation of the two when under stress.

In operation, the molten metal is passed between two rolls, cooled, and ejected as a metal sheet. The thickness of the sheet is adjusted by varying the space between the rolls. The present roll and shell assembly is particularly useful for manufacturing aluminum sheets, but sheets of other metals like copper, zinc and the like, may also be manufactured with these roll and shell assemblies.

The method for obtaining a roll 10 can be described as follows. A core 12 made of conventional material, for example steel or alloyed steel, is installed in a chamber and heated to a temperature of from 200° to 275° C. until the core is hot through the entirety of its structure (4–5 hours). Preferably, before heating the rolls, graphite plugs have been inserted in the holes of the channels in the core. Then, a first layer of stainless steel is welded onto the core, and this operation is repeated until the desired thickness of overlay 14 is reached.

Subsequently, a first layer of stainless steel having a hardness higher than that of overlay 14 is welded on overlay 14, and this operation is repeated until the desired thickness of overlay 16 is obtained. The roll is then placed in an insulated box and heated to a temperature of from 200° to 275° C. The box is closed and the temperature is maintained to 200°–275° C. for another 6–8 hours. The temperature is then lowered slowly to room temperature. It should be noted that during all the above process, the roll is preferably turning at a speed of about 1 rpm. Finally, the water channels 13 are cut in overlays 14 and 16.

While the invention has been described in connection with specific embodiments thereof, it will be understood that it is capable of further modifications and this application is intended to cover any variations, uses or adaptations of the invention following, in general, the principles of the invention and including such departures from the present disclosure as come within known or customary practice within the art to which the invention pertains, and as may be applied to the essential features hereinbefore set forth, and as follows in the scope of the appended claims.

What is claimed is:

1. A method for manufacturing a roll for making metal sheets or foils, the roll comprising:

a core having a plurality of cooling channels;

a first overlay of stainless steel on the core; and a second overlay of stainless steel on the first overlay of stainless steel, the second overlay having a hardness higher than the hardness of the first overlay, the method comprising the steps of:

heating the core to at least 200° C.;

welding the first overlay on the core;

welding the second overlay on the first overlay;

maintaining the temperature to at least 200° C. for several hours;

cooling the core to room temperature;

cutting the cooling channels in the first and second overlays and shrink-fitting a shell onto the core.

2. A method according to claim 1, wherein the hardness of the first overlay is from 20 to 25 on the Rockwell "C" scale, and the hardness of the second overlay is from 50 to 56 on the Rockwell "C" scale.

3. A method according to claim 1, wherein the thickness of the first overlay of stainless steel is lower than the thickness of the second overlay of stainless steel.

4. A method according to claim 1, wherein the thickness of the first overlay is about ⅛", and the thickness of the second overlay is at least ⅛".

5. A method according to claim 1, wherein the first and second overlays are made of several layers.

6. A method according to claim 1, wherein the shell has its inner surface electroplated with chromium.

7. A method according to claim 1, wherein the metal is aluminum.

* * * * *